United States Patent [19]

Kramer

[11] 4,385,841

[45] May 31, 1983

[54] DIGITAL PROGRAM CONTROL CLOCK

[76] Inventor: Justin Kramer, 1028 W. 8th Pl., Los Angeles, Calif. 90017

[21] Appl. No.: 174,680

[22] Filed: Aug. 1, 1980

[51] Int. Cl.[3] ..... G04B 19/24; G04C 19/00; G04F 8/00

[52] U.S. Cl. ..... 368/29; 368/82; 368/111; 340/309.4

[58] Field of Search ..... 368/10, 12, 21, 28, 368/29, 107–113, 256, 25 R; 340/309.1, 309.4; 364/144–146, 569, 420; 236/46 R; 307/141, 141.1, 141.4

[56] References Cited

U.S. PATENT DOCUMENTS

| | | | |
|---|---|---|---|
| 4,044,545 | 8/1977 | Shimizu | 368/22 |
| 4,079,366 | 3/1978 | Wong | 340/309.4 |
| 4,081,754 | 3/1978 | Jackson | 340/309.4 X |
| 4,165,532 | 8/1979 | Kendall et al. | 364/420 |
| 4,168,525 | 9/1979 | Russel | 364/569 |
| 4,176,395 | 11/1979 | Ueere et al. | 364/420 |
| 4,193,120 | 3/1980 | Yello | 364/145 X |
| 4,204,196 | 5/1980 | Sueda | 340/309.4 |
| 4,264,034 | 4/1981 | Hyltin et al. | 340/309.4 X |
| 4,300,199 | 11/1981 | Yoknis et al. | 364/557 |

*Primary Examiner*—Vit W. Miska

*Attorney, Agent, or Firm*—Vernon D. Beehler

[57] ABSTRACT

An electronically actuated system for a control clock device is provided with an instrument panel arranged in such fashion that an operator having virtually no familiarity with the technical aspects of the system can set up a program of activity, such for example as the playing of various melodies on a carillon on different days of the week, and varying them automatically from day to day. The panel is provided with controls in the form of push buttons, dials and lights, appropriately labeled, a digital clock face showing the time of day in hours, minutes and seconds, selectors for the day or days during the week when a program is to be played, and a selector for any one or more of the programs from a bank of programs. Visual displays show what has been set up in the device as a check against errors which the operator may have made during the setting.

In the event an error has been made there is a control button for erasing the error so that a correct setting can be substituted and, after all settings have been properly made and entered in the system, another control means makes possible setting the clock to the correct time of day whereafter operation will continue automatically.

At any later date by manipulation of another control device the operator can quickly review an entire week's schedule of programs so that desired changes can be made in part or all of the schedule.

18 Claims, 4 Drawing Figures

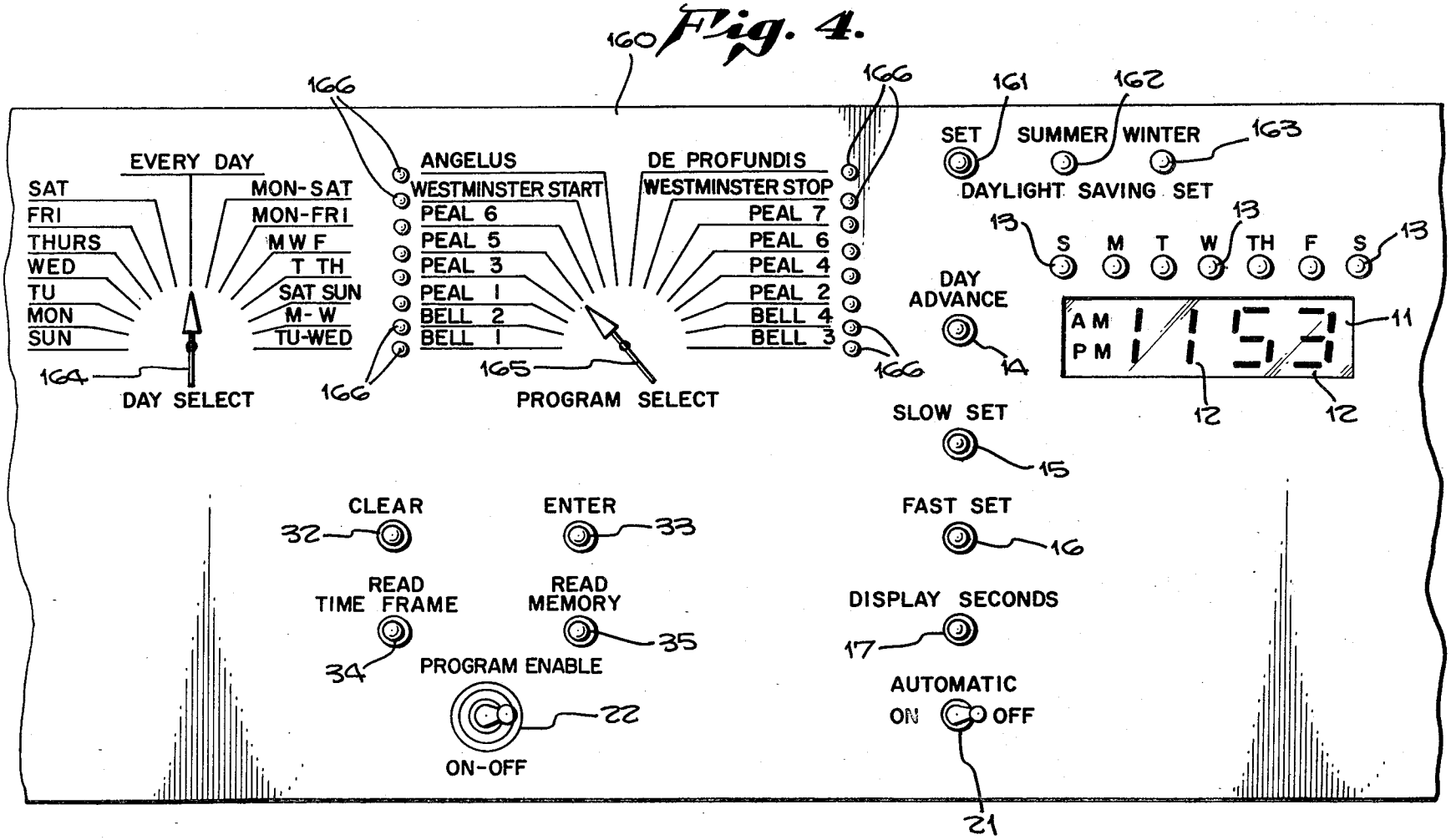
SET
SUMMER
WINTER
DAYLIGHT SAVING SET
S M T W TH F S
AM
PM
DAY ADVANCE
SLOW SET
FAST SET
DISPLAY SECONDS
AUTOMATIC
ON
OFF
DE PROFUNDIS
WESTMINSTER STOP
PEAL 7
PEAL 6
PEAL 4
PEAL 2
BELL 4
BELL 3
ANGELUS
WESTMINSTER START
PEAL 6
PEAL 5
PEAL 3
PEAL 1
BELL 2
BELL 1
PROGRAM SELECT
ENTER
READ MEMORY
PROGRAM ENABLE
ON-OFF
CLEAR
READ TIME FRAME
EVERY DAY
MON-SAT
MON-FRI
M W F
T TH
SAT SUN
M-W
TU-WED
SAT
FRI
THURS
WED
TU
MON
SUN
DAY SELECT
Fig. 4.

DIGITAL PROGRAM CONTROL CLOCK

Among program clocks or timers which have been used extensively in industry, schools, churches, et cetera for many years, one well-known type consists of a large dial which is divided into twenty-four major divisions corresponding to the twenty-four hours of each day. Each of these major divisions is then usually subdivided into four or twelve subdivisions. In other words, the one having four divisions for each major division would provide a time slot every fifteen minutes and the one having twelve subdivisions would provide a time slot every five minutes. Programming of these clocks is ordinarily accomplished by putting a clip at one or more of the desired time slot(s) on the twenty-four-disk which makes one revolution each twenty-four hours. For example, if the need is to control outdoor lighting to turn on the lights each evening at 7:00 p.m. and turn the lights off each morning at 6:00 a.m., one clip would be placed at the 7:00 p.m. slot and another at the 6:00 a.m. slot.

A more sophisticated version has, in addition to a dial which revolves once each twenty-four hours, a second dial which must also be programmed with clips and which revolves once each week. The latter has seven time slots. Therefore, besides being able to select the time of day, it is possible to select the day or days of the week on which the program is to play.

In the example just given, if it were desired to have the lights turned on every day but Wednesday, clips would be placed in each day slot except Wednesday. This system has the disadvantage of requiring the program to be the same on each of the days selected. For example, it would not be possible to have the lights turn on every day but Wednesday at 7:00 p.m. but be turned on Thursday at 6:00 p.m. In order to have such a condition, a second set of program wheels would be required. One set would be programmed for every day but Wednesday and the other set for Wednesday only.

It can be seen that if different programs are desired for different days, the system can be quite complex, especially if there is more than one function to control. For example, in a more sophisticated programmer, besides lights there could be bells, fountains, heaters, et cetera.

Another approach has been to use a punched tape which could cover a period of a week. Such a punched tape would have time slots which would reoccur only once per week. Still another approach makes use of a chain with each link representing a time slot. Since each twenty-four-hour period has 1440 minutes, if each time slot were related to a minute, a seven-day program capability would require a total of 10,808 time slots. In such a system, each function or device to be controlled would require its own tape or chain. For example, should there be sixteen functions and a tape for each function, there would be sixteen tapes, if tapes were being used, or sixteen chains in the case of chains, requiring in each instance a total of 161,280 time slots exemplifying the complexity of such a system.

As an alternative to the electro-mechanical timers just described, there have been more recently electronic times which have emerged as the result of the computer industry. These timers are ordinarily programmed from computer terminals or keyboards, or by punched cards. The last identified timers all share one troublesome disadvantage in that they are difficult for the non-technician to program since they require a knowledge of computer language.

Among the objects of the invention, therefore, is to provide a new and improved low-cost electronic program timer that can be programmed simply and by a non-technician.

Another object is to provide a new and improved low-cost program timer which can be made with time slots occurring on the minute in a variety of seven-day programs.

Still another object of this invention is to provide a new and improved program timer having the capability of automatically adjusting to daylight saving time when simply programmed to do so by the user.

Still further among the objects of the invention is to provide a new and improved digital program control clock which can be set, read, checked, and reset if need be to provide a program of musical renditions varying from day to day, and from hour to hour as long as a week at a time, the settings being such as to be within the capability of persons of modest skill and displayed graphically in an easy to read form whenever needing to be checked or varied.

With these and other objects in view, the invention consists of the construction, arrangement, and combination of the various parts of the device serving as an example only of one or more embodiments of the invention, whereby the objects contemplated are attained, as hereinafter disclosed in the specification and drawings, and pointed out in the appended claims.

FIG. 3B is a right-hand half of the schematic diagram of which FIG. 3A is the left-hand half.

FIG. 4 is a second form of panel for programming to a degree more simplified than FIG. 1.

Figures 1, 2:
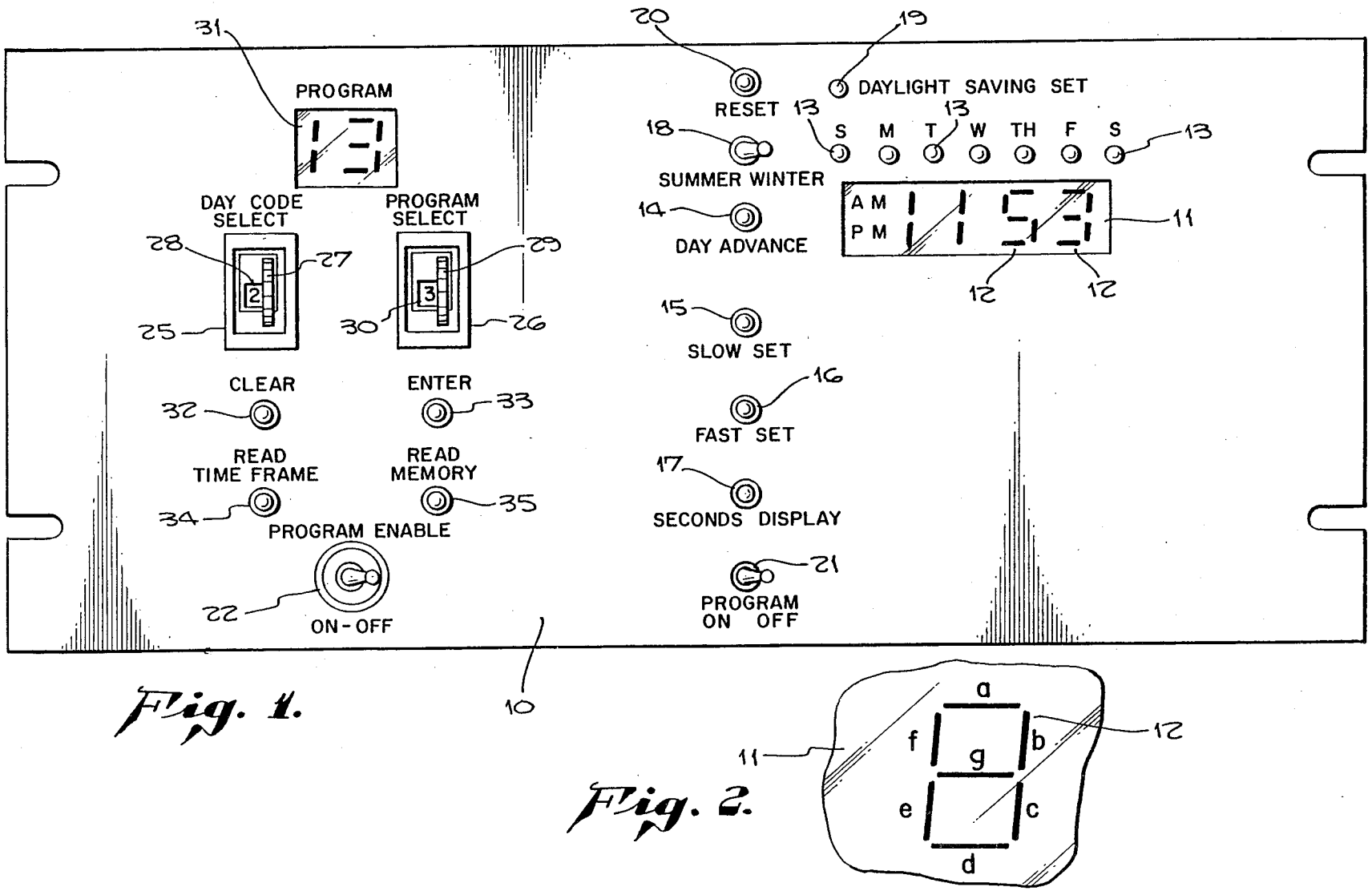
FIG. 1 is one form of panel for programming bell devices such as a carillon for different performances daily throughout a seven-day period.
FIG. 2 shows the make-up of one of the numerals of the digital clock.

In an embodiment of the invention which has been chosen for the purpose of illustration a program timer control panel 10 is illustrated in FIG. 1. The panel contains all of the controls and displays which the system requires. On the panel is a typical solid state numerical four-digit clock display 11 which, in addition to minutes and hours starting at 12:00 to 11:59, also indicates the time as a.m. or p.m. FIG. 2 shows one of the digit locations 12 of the four-digit display, revealing the seven segments by means of which any one of the digits from zero to nine may be displayed at those locations requiring the full complement of digits.

Above the four-digit clock display 11 is a series of seven light emitting diodes (LED's) 13. The LED's are labeled, one for each day of the week, Sunday through Saturday, inclusive. For advancing the day of the week display, there is provided a push button 14 which has been labeled as "day advance." By pushing the push button 14 successively, the LED's are illuminated successively indicating which day of the week the panel is being set for, or, having been set, indicating the actual day of the week as the program is being played.

For the setting procedure, additional push buttons are provided. For example, a push button 15, labeled "slow set" is made use of to slowly advance the clock display 11 minute by minute at a slow rate, namely 2 Hz. Another push button 16 labeled "fast set" advances the time display at a faster rate, as for example 60 Hz. There is also provided a push button 17 identified as "seconds display." When this button is pushed, the showing on the clock display 11 is interpreted as minutes and seconds rather than hours and minutes.

To take care of the changes between standard time and daylight time, there is a toggle switch 18 labeled "summer-winter" which functions in company with an LED 19 labeled "daylight saving set." The toggle switch 18 is used to program the timer to automatically adjust to daylight saving time as for example at 2:00 a.m. on Sunday. To implement such a time change the switch is moved into either summer or winter position, preferably any time during the week preceding the 2:00 a.m. Sunday date for the time change. The display is such that as soon as the switch of the toggle switch 18 is moved, the LED 19 will light indicating that the program has been set. The same LED will remain lighted until the desired change occurs, at which time it will go dark. Should there be occasion to cancel the daylight saving programming, a reset switch button 20 is provided. Manipulation of the reset switch changes the LED 19 from light to dark and cancels whatever program may have been given. This is useful in case the summer-winter time button 18 was accidentally set.

Under such circumstances, in order to reset the program for the time change, the toggle switch 18 is first moved to the opposite position, and then returned to the desired position.

For turning on or off clock program commands, there is provided an on-off toggle switch 21. This toggle switch 21 is an automatic operation "on/off" switch. When the program is being entered into the memory, another important switch must be provided, namely a program enable switch 22. The program enable switch functions in a fashion such that in order to enter a program into memory so that it will play automatically at the time for which it has been set, the program enable switch must be turned to "on" position. During this setting up of program, the four-digit clock display 11 and the LED's 13 no longer display the real time of day.

Additional controls for implementing the simplified control panel 10 appear on the left. Included among these is a day code select switch 25 and a program select switch 26. The day code select switch 25 includes a wheel 27 which when rotated reveals numeral setting 28 indicating a day code which determines the day or days of the week for which a program has been set. The program select switch 26 includes a wheel 29 adapted to operate with a numeral setting 30 for one of an assortment of different programs for which the control panel can be set at a given time on a selected day. Accompanying the program select switch is a two-digit display 31 for use with a selection of programs which can be revealed by numbers of no more than two digits, the two-digit display being more than adequate for most needs. Additionally important to the program is the provision of a clear push button 32, and enter push button 33, a read time frame push button 34 and a read memory push button 35.

Supported by the circuitry to which the various controls of the panel 10 are connected, a person of no more than moderate skill and with no knowledge of computer programming can with the controls described in connection with the display panel 10 select any program from a bank of programs provided in the system and set the time of day and day or days of the week at which time the program is to be played, through other periods of successive seven-day weeks. As many different programs as is within the capacity of the system can be set up for any minute of any hour of any day throughout the seven-day week, after which the weekly program will continue to be repeated.

In making use of the panel for programming, the procedure is substantially the following: First the program enable switch is turned to "on" position. When this adjustment has been made, the clock display 11 will no longer display real time, but only such time as is chosen for it during the setting operation. The precise time of day at which the program is to play is then set in the clock display 11. This is accomplished by pushing first, for example, the fast set push button 16 until the clock display is near the hour chosen, after which the push button 15 is manipulated to gradually move the time display to the chosen hour and minutes. The next setting is by manipulation of the day code select switch 25 by rotating the wheel 27 until the numerical setting 28 appears representing the particular day or a combination of days on which the program is to be presented at the chosen hour. The program select switch is then rotated until the number shows which represents the function or program which is to play at that time or times. In the chosen example, sixteen different functions are shown. It should be borne in mind, however, that the number need not be limited to that figure.

When the foregoing settings have been made, the enter push button 33 is depressed. The program represented by the numerical setting 30 of the program select switch 26 will be displayed in the program display 31 and the days of the week at which the program is to play will be displayed by the appropriate lighted LED's 13. If for any reason there is an error in the program display 31, or with the day of the week LED 13 corresponding to that desired, and the hour-minute display is not for the time called for, the clear push button is depressed. At the same time the program display 31 will no longer be lighted, nor will any of the LED's 13.

When these two displays are no longer lighted, no program has been stored for the time indicated on display 11.

The number of programs that can be stored in different time slots is limited only by the size of the necessary random access memories (RAM's). For the purpose of illustration, there has been selected three inexpensive random access memories (RAM's) which could store for example as many as 128 such programs.

Under circumstances where an assortment of programs have been stored in the memory and programmed to play at the specific times on the selected days, the system is such that they can be readily checked and reviewed, and in a relatively short space of time. For example, should it be desired to read the entire memory, the clock display 11 is set to indicate 12:00 a.m. This can be accomplished by turning the program enable switch 22 to "on" position and then by manipulation of the push buttons 16 and 15, to set the clock display to its desired time, namely 12:00 a.m. The read memory push button 35 is then depressed. If nothing has been stored in the 12:00 a.m. time slot, the time indicated in the clock display 11 will rapidly advance until it reaches the time slot where the first program information has been entered in the memory. Because of possible variations in the daily programs, it is important to note that the same hourly time slot can have a variety of programs stored in it. As for example a different program for each seven successive days, or several different programs on the same day. When the time slot in which the earliest program material is stored appears, the clock display will stop advancing the time and the identification number of that program will be displayed in the program display 31. At the same time the corresponding LED 13 (or LED's) applicable to the chosen day(s) of the week will light. If by any chance, it is desired to remove this particular program from the memory, the operator merely pushes the clear push button 32. If on the contrary the same programming is to be continued, the operator proceeds with the next step.

The next step, in this sequence, is to push the read memory push button 35. If more than one program has been stored in the memory in the same time slot, another program number will be immediately displayed in the program display 31 and corresponding LED(s) 13. In the absence of some desire to eliminate a program, successive pressures on the read memory push button 35 are continued until all programs at the selected time slot have been displayed in the program display 31. When the last program in the time slot is on display, if the read memory push button 35 is again pushed, the clock display 11 will rapidly advance to a time where the next time slot appears wherein program material is stored, and then stop advancing. At that time indication of the program information is displayed and additional pressures on the read memory push button 35 will continue to reveal successive programs in the manner described above. This process can continue until the clock display 11 has advanced through its cycle and has again reached 12:00 a.m.

Should it be desired on the part of the operator to read a portion only of the memory, the step involving setting of the clock display 11 to 12:00 a.m. is omitted. Instead the clock display 11 is set to the time of the first time slot desired. The read memory push button 35 is then pushed and the reading progresses in the same manner as has just been described.

As still another alternative, should it be desired to read only the programs stored in a single time slot, the clock display 11 is set to that particular time slot by the use of push buttons 15 and 16 and then the read time frame push button 34 is pushed. The first program stored in that particular time slot will be immediately displayed by its number in the program display 31, and lighting of the LED(s) 13 for the appropriate day(s). Should there be more than one program stored in that particular time slot, successive programs will be displayed in the program display 31 each time the read time frame push button 34 is pushed. When the first program number which has been displayed reappears, all of the programs in that particular time slot will have been displayed. Should only one program have been stored in that time slot, the program display 31 will not change irrespective of how many times the read time frame push button 34 is pushed. If it is desired to remove a program from a time slot, pressing the clear button 32 will achieve this provided this is done while the program is in display and the program enable switch 22 is in "on" position.

Figure 3A:
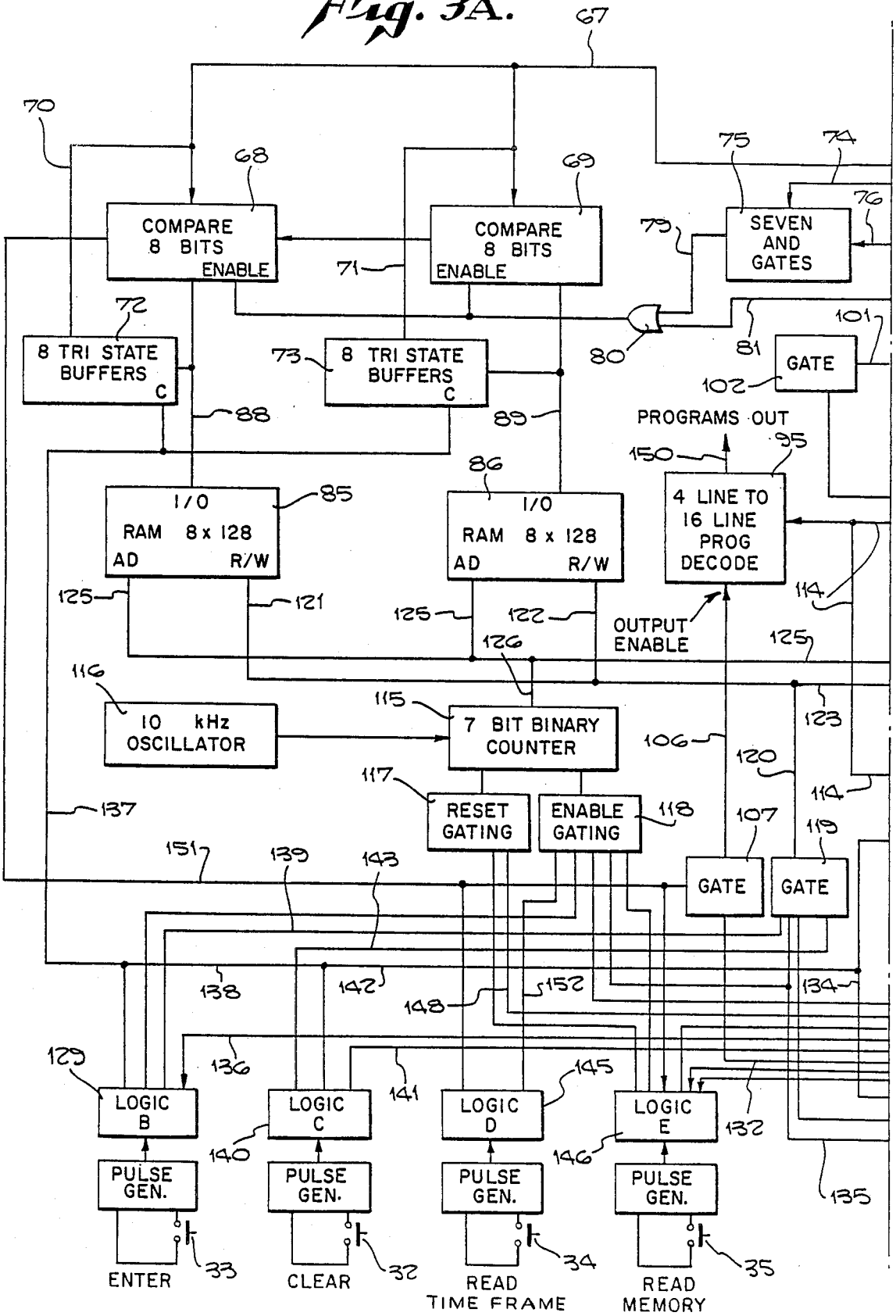
FIG. 3A is a left-hand half of a schematic diagram of the interconnected components of the electronic system.
Figure 3B:
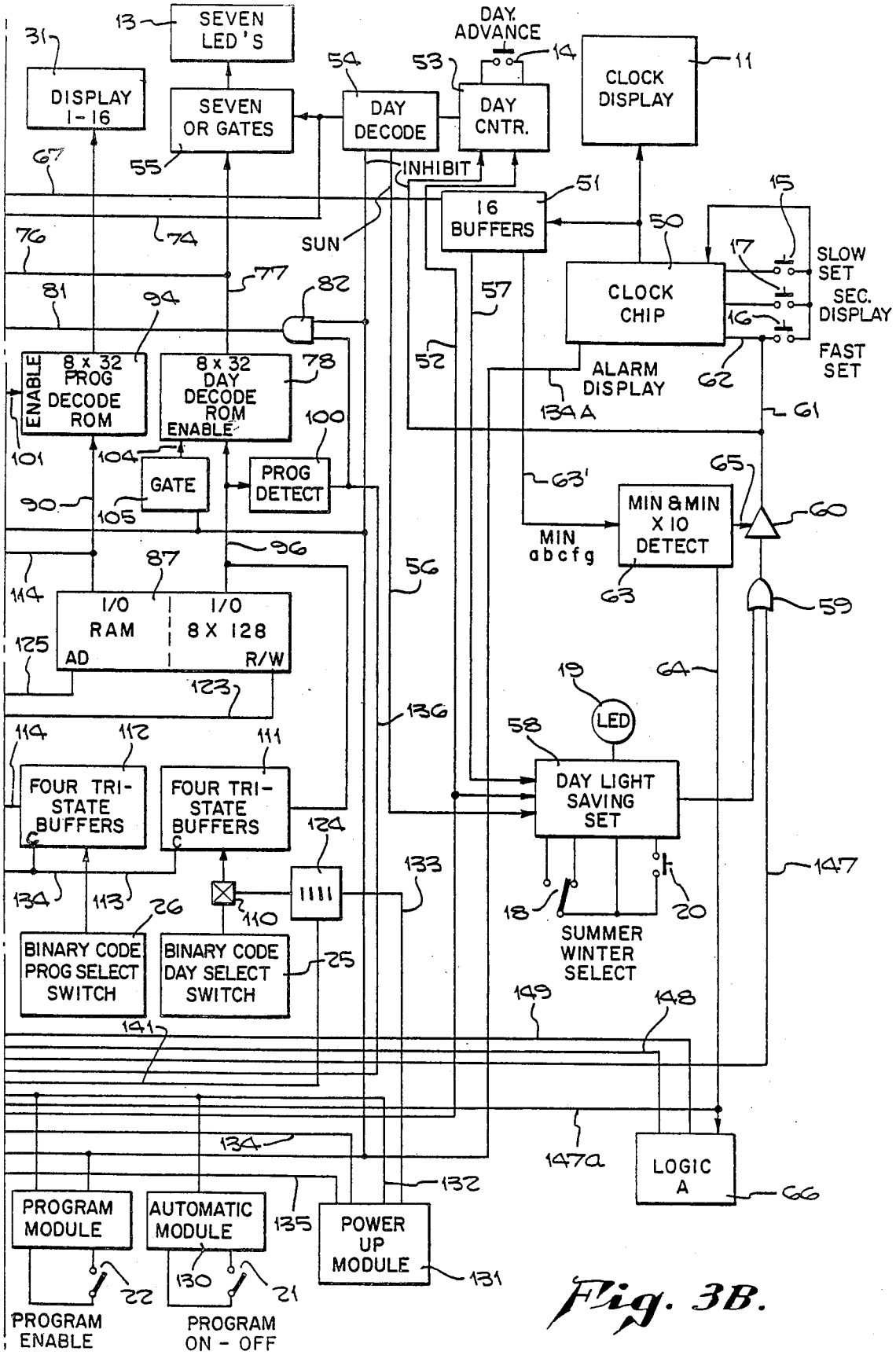

One form of logic capable of providing all of the program setting and reproduction described in connection with panel 10 is shown in FIGS. 3A and 3B which together in left-hand and right-hand position comprise a single diagram. Significant push buttons and displays already identified on the control panel 10 are repeated schematically in FIGS. 3A and 3B.

For implementing the four-digit clock display 11 there is provided a clock chip 50. This can be a commercially available large scale integrated circuit (LSI) which includes provisions for driving the clock display, namely a seven-segment time-of-day display through static lines (non-multiplex). One of the features of the clock chip 50 is that it can display not only the time of day, but also some other time as for example an alarm display which could be set to operate at any time without disrupting the normal counting of seconds, minutes, hours, a.m. and p.m. Sixteen of the twenty-four lines to the clock display 11 are used to supply a special logic to identify time slots.

The logic is as follows:

| | Number of lines |
|---|---|
| A.M. | 1 |
| Hours times 10 = segment b c | 1 |
| Hours = segments a, b, e, f, g | 5 |
| Minutes times 10 = segments a, b, e, g | 4 |
| Minutes = segments a, b, e, f, g | 5 |
| | 16 |

In accordance with the foregoing code, it will be clear that conversion to a standard binary code would not appreciably reduce the bits of information required by the system. The sixteen selected lines, in addition to serving the clock display 11, are also connected to sixteen buffers 51. The buffers serve as an interface between the clock chip 50 and the balance of the system.

Note that an a.m. buffered line 52 is connected to a standard binary counter identified as "day counter" 53. The day counter 53 counts from one to seven and is advanced one count each time the clock chip 50 changes from p.m. to a.m. The output from the day counter 53 is decoded in a day decoder 54. This is a standard binary to ten line decoder whose seven selected outputs are in turn sent to seven two input OR gates 55. The seven OR gates drive the seven LED's 13. It should also be noted that the day counter 53 can also be advanced by the day advance push button 14.

A Sunday signal output line 56 from the day decoder 54, an a.m. signal line 52, and circuit path 57 from the sixteen buffers 51 carrying signals from the hours×10 "bc" segment, and the hours "c" segment are connected to a day light saving module 58. Information provided by these signals is used to detect Sunday at 2:00 a.m. The manner of setting this module has already been described. Its construction can be according to any of a number of well-known solid state logic structures.

After the day light saving set module has been set, depending on whether it is set for summer or winter, as soon as it detects Sunday 2:00 a.m. it will advance the clock chip 50 either one hour or twenty-three hours by completing a circuit through OR gate 59 and a controlled buffer 60 to a line 61 which operates the fast set line 62 of the clock chip 50. It might be noted that the detection of 2:00 a.m. Sunday requires only a single four input AND gate and two inverters, i.e., Sunday 2:00 a.m. equals signals from Sunday and a.m. plus no signals from hours×10 and "c" segment of hours. The day will not be advanced when the twenty-three hour advance takes place because every time fast set line 62 is activated, the day counter 53 is inhibited from counting.

The buffered minute segments a,b,e,f,g as depicted in FIG. 2 are connected via circuit path 63' to a minute and a minute times ten detector module 63. This module 63 has two outputs 64 and 65. Each time it detects that a minute has changed it provides a short pulse through the output 64 to a logic A module 66. Each time that a minute change is from nine to zero, it supplies a longer pulse by way of the output 65 to the control input of the buffer 60, turning it off for the duration of the pulse. The delay is to overcome the problem of "racing" that would occur every time more than one digit of the clock chip 50 is updated. The pulse is just of sufficient length to allow all possible updating to occur before permitting the fast set lines 61 and 62 to be reactivated by an output from OR gate 59.

Each of the several outputs from the sixteen buffer module 51 is connected via circuit path 67 to one input of respective comparators 68 and 69 and via circuit paths 70 and 71 to respective tri-state buffers 72 and 73. The seven outputs from the day decoder 54 are each connected through circuit path 74 to one input of seven two input AND gates 75. The other input line of each of these seven AND gates is connected via circuit path 76 to one output line of circuit path 77 from a day decode read only memory (ROM) 78. The output from each of the seven AND gates 75 is connected to one input of an eight input OR gate 80 via circuit path 79. The remaining input 81 of the OR gate 80 is connected to the output of a two input AND gate 82.

It is of significance to note that at this time the seven LED's —can be lighted from the outputs of either the day decode ROM 78 or the day decode 54 by means of the seven two input OR gates 55.

All information which is to be retained by the system is stored in random access memories (RAM's) 85, 86 and 87. RAM's 85 and 86 are shown in FIG. 3A; RAM 87 in FIG. 3B. Input/Output lines circuit paths 88 and 89 from RAM's 85 and 86 are connected to inputs of comparators 68 and 69, whose outputs are enabled by OR gate 80, where they are compared with the outputs of the sixteen buffers 51. Four input/output lines of RAM 87 are connected to four address inputs of a program decode ROM 94 via circuit path 90 and the a,b,c,d inputs of a four line to sixteen line program decoder 95. The remaining four input/output lines of RAM 87 are connected to the address inputs of the day decode ROM 78 and to the program detect module 100 via circuit path 96. Program detect module 100 provides a Hi output every time there is any input except 1111 in the address lines to the day decode ROM 78. The program decode ROM 94 is enabled through line 101 by gate 102 (see FIG. 3A) and the day decode ROM 78 (see FIG. 3B) through line 104 by gate 105.

The program decoder 95 is in turn enabled through a line 106 by a gate 107.

The four output lines of the day select switch 25 are connected via 4 two input OR gates 110 to four tri-state buffers 111 whose output is connected via circuit path 96 to RAM 87, ROM 78 and Program Detect module 100. The four outputs of the binary coded program switch 26 are connected to four tri-state buffers 112 whose outputs are connected to the program decode module 95 to RAM 87 and program decode ROM 94 via circuit paths 114 and 90 respectively. The previously identified RAMS's 85, 86 and 87 are all addressed by a seven-bit binary counter 115 which counts from zero to 127, and connects to the RAMs by branches 125 of a line 126. The counter 115 is clocked by a ten kHz oscillator 16, reset by a reset gating module 117 and enabled by an enable gating module 118.

The previously identified RAM's 85, 86 and 87 are transferred from the read mode to the write mode by gate 119 by way of lines 120, 121, 122 and 123. The four outputs of a 1111 module 124 (see FIG. 3B) are connected to the four tri-state buffers 111, via four two input OR gates 110. An output of all Hi's from 1111 module 124 indicates no day has been selected. In other words the program will not be complete under such conditions.

At times it may be desirable and necessary to inhibit the program timer from supplying any commands to the outside world. If for example it was required that all program output be inhibited for a certain period of time, this may be done by turning the automatic program on/off switch 21 to "off" position. This would cause an automatic module 130 to close the gate 107 via line 132 which would inhibit the output from the program decode module 95. It would also be necessary to inhibit the output of the program decode module 95 at times when the clock display 11 is being set, during a power up condition and during the time when the memory is being programmed.

Because of the fact that in a power up situation, that is, when power is applied to the RAM's 85, 86 and 87, they assume a random state, it is necessary in such a case to remove any programs from the memory which may have been set under such random action and in effect clear the memory, thereby providing a clear memory for re-programming. This is achieved by the operation of a power up module 131 (see FIG. 3B). As soon as power is on, the power up module 131 puts out two pulses. One pulse is long, for example 0.016 seconds; the other pulse is short, for example 0.014 seconds. The long pulse acting through a line 132 will hold the gate 107 off and acting through a line 133 hold the module 124 on. The short pulse acting through a line 134 would hold the tri state buffers 111 and 112 in "on" position and acting through the line 135 hold the write enable gate 119 on and the counter enable gate 118 on. This activity will write all ones in that half of RAM 87 which contain the day code data namely the 128 four-bit words, which address the day decode ROM 78. Day decode ROM 78 will indicate no day selected because a code of 1111 is not assigned to any day(s). Program detect module 100 will detect an incomplete program, therefore, no program. Therefore, the result will be to effectively clear all programs from memory, i.e. those set random by the power up.

In writing a program into the memory, the following circumstances occur:

A. The program enable switch 22 is turned to "on" position. This causes five conditions to remain in effect as long as the switch is in the "on" position.

1. An alarm display line 134A of the clock chip 50 is enabled. This means that the clock display 11 will no longer display real time but rather any time that might be set in the clock chip alarm circuit.
2. The day output of the day decode module 54 (see FIG. 3B) will be inhibited so that it will supply no signals to any of the seven OR gates 55.
3. One input of the two input AND gate 82 will be held high.
4. Gates 102 and 105 will be turned on thereby enabling the outputs of the program decode ROM 94 and day decode ROM 78.

5. The gate 119 will be enabled to accept commands from logic modules B and C to put RAM's 85, 86 87 in the "write" mode.

B. When the clock display 11 has been set to the desired time slot, the code for this time slot will be presented to the inputs of the tri-state buffers 72 and 73 (see FIG. 3A) by the sixteen buffers 51. When the day or days have been selected by means of the day select switch 25 (see FIGS. 1 and 3B), the output of this switch 25 will be fed to the four inputs of the four tri-state buffers 111. When the program select switch 26 (again see FIGS. 1 and 3B) has been set, its four outputs will be fed to the four inputs of the four tri-state buffers 112. It should be noted that the four output lines of these switches 25 and 26 provide the signals of a conventional binary code.

C. When the enter push button 33 is pushed (see FIG. 3A), a pulse is sent to logic B module 129 and starts its cycle. This cycle writes into memory the time of day, day(s) of week, a program as selected on program select switch 26, is to play.

It has already been shown that the four outputs from the RAM 87 which contain the day code are connected to the day decode ROM 78 address inputs and also to the program detect module 100.

When logic B module 135 is activated it first samples the input received from the output of the program detect module 100 by way of line 136. If it detects program material, it turns on enable gating module 118 via line 152 which permits the counter 115 to begin counting. When absence of output from the program detect 100 is sensed thereby indicating the absence of a program in the memory slot addressed it shuts off the enable gating module 118 and the counter stops. If there is no output sensed from the program detect 100 when the logic B module 135 begins its cycle, enable gating module 118 will not be turned on.

The next portion of the logic B module cycle supplies a signal over line 137 to the control gates of tri-state buffers 72 and 73 (see FIG. 3A), and by way of the line 138 to the control gates of the tri-state buffers 112 and 111 (see FIG. 3B), turning them on. Following the turn-on, a pulse is applied through line 139 to the gate 119. This operation puts RAM's 85, 86 and 87 in the "write" mode, writes the inputs from the buffers 72, 73, 111, 112 into RAM's 85, 86 and 87 as words numbered according to the output of the seven bit counter 115. After the words have been written into the RAM's, the signal to the control inputs of the tri-state buffers 72, 73, 111 and 112 is turned off and the cycle of logic B module 129 has been completed.

D. When the clear push button 32 is activated, a pulse is sent to logic C module 140 which begins its cycle. First the logic C module 140 by way of a line 141 turns on the 1111 module 124 and activates by way of lines 138 and 137 the control inputs of the tri-state buffers 72 and 73 (see FIG. 3A), and by way of the lines 142 and 134 activates the control inputs of tri-state buffers 112 and 111. It then supplies a pulse to the gate 119 by way of line 143 which writes the outputs from the buffers 72, 73, 111, 112 into the RAM's 85, 86 and 87 as words numbered according to the output from the seven bit counter 115. After this, the signal to the module 124 and tri-state buffers 72, 73, 112 and 111 is removed and the cycle of the logic C module 140 is complete. According to the foregoing procedure, all ones were written into the RAM 87 for the four bit word representing no day selected in the day code. Since there is no day code at this memory address, the program formerly at this address has been made inoperable and program detect module 100 will detect no program at this address position.

E. When the read time frame push button 34 is activated, a pulse is sent to logic D module 145, which turns on the enable gating module 118, via line 152, and which in turn enables the seven bit binary counter 115 (see FIG. 3B). It has already been noted that the comparators 68 and 69 are enabled by the OR gate 80. It has also been noted that these compare the outputs from the sixteen buffers 51 with the outputs from the RAM's 85 and 86. This is important for an understanding of the operation of the read frame function. This function is to display the program or programs which are in a given minute of a 24-hour time slot.

Logic D module 145 will continue to supply a signal to the enable gating 118 until it receives a signal from the output of comparator 68. This will occur when the sixteen outputs from the buffers 51 are of the same relative potential as the corresponding sixteen outputs from the RAM's 85 and 86, and the program detect module 100 is supplying a Hi signal to the AND gate 82.

When this occurs, the program of logic D module will be interrupted and a program code number and the time the program is to play will be displayed on panel 10. The program of the logic module D will not continue until push button 34 is again pushed. When this is done the counter 115 will again be enabled and stop only if a signal is received from comparator 68. If there is a second program in the same time slot, the program of the logic D module will be interrupted and must be started again by pushing button 34. If there is no program(s) in a selected time slot, successive pushing of button 35 will result in no program code being displayed on panel 10. If only one program is in a selected time slot, successive pushing of button 35 will result in the same program code being displayed each time the button 35 is pushed.

F. When the read memory push button 35 is activated, a pulse is sent to a logic E module 146. This module will act in such a way so as to display the program or programs which might be located in the time slot displayed by the clock display 11 and then advance the clock display to the next time slot where there is a program(s) and successively to time slots where there are programs until the clock display indicates 12:00 a.m. When the logic E module 146 is activated, it first resets the counter 115 by means of the reset gating 117. This reset gating 117 is so designed that the counter will not be reset again by it until after the counter 115 has made the full count. This reset gating 117 is further so designed that it will also inhibit the next operation of the logic E module 146 until the full count. After resetting the counter it enables the counter which proceeds to count in a way similar to that described in the operation of logic D module 145. In other words, logic E module will continue to supply a signal to the enable gating 118 until it receives a signal from the output of comparator 68 signaling the existence of a program. When such a signal is received, the counter will be stopped and the result will be that the program code together with the time the program will play will be seen in their respective displays on the panel 10. This will interrupt the program of the logic E module. The program interrupt of the logic E module will continue until the push button 35 is again pushed. When push button 35 is pushed, logic E module 146 will again enable the counter 115. If another signal is received from comparator 68 before the full count on the counter, logic E module will stop the counter and the program data will be displayed as before on panel 10. The program of logic E module will likewise be interrupted until push button 35 is again pushed. This process will continue until the full count is reached by the counter. When the full count is reached, on the counter, the logic E module 146 resets the counter 115 and provides by way of line 147 a continuous signal to the OR gate 59 (see FIG. 3B) advancing the clock display one minute, the arrival of the next minute being sensed from the output of minute and minute×10 module 63 via line 147*a*. When the clock has been advanced one minute, the logic E module will again enable the counter and the process just described for the minute before will be repeated. If the counter is not stopped and the program of logic E module 146 interrupted by a signal from comparator 68, the logic E module 146 will, on the full count of counter 115 reset the counter and then advance the clock one minute according to the procedure described above. When the clock has been advanced one minute, the process just described for the former two minutes will be repeated. This process will continue until the program of the logic E module is stopped by a signal via line 52 indicating the change from p.m. to a.m. has taken place and that all time slots up to 12:00 midnight had been searched for programs.

G. When the automatic program on/off switch 21 is in the "on" position and the program enable switch 22 is in the "off" position, the automatic programs operate in the following manner. Each time the logic A module 66 receives a pulse from minute and minute times ten detect 63 by way of line 64 (see FIG. 3B) indicating that a new minute has arrived it first sends a pulse by way of line 148 to reset gating module 117 (see FIG. 3A) which resets the counter 115 to zero and immediately thereafter sends another pulse by way of line 149 to the enable gating module 118 which will enable the counter 115 and cause it to make a full count and then shut down.

The operation of logic A module 66 will produce certain results. It has already been noted that the outputs from the day decode module 54 are each combined with one output from the day decode ROM 78 in one of the seven AND gates 75 and that the outputs of each of these AND gates 75 is connected to one input of the eight input OR gate 80 which enables comparators 68 and 69.

As a consequence of the foregoing procedure, when any match is made between the decoded day code stored in RAM 87 as a four bit word and the day as displayed by one of the seven LED's 13 as lighted from the day decode 54, the comparators 68 and 69 will be enabled. Whenever this match is made and the data presented to both sides of the comparators compares, comparator 68 provides a signal on the line 151 which is connected to the gate 107. The gate 107 then enables the output of the program decode 95 (see FIg. 3B) which is connected to four outputs of the Ram 87 (see FIG. 3B). The four outputs of the RAM 87 contain the coded functions in four bit words which correspond to the function that is to be performed at the time slot which has just been compared on both sides of the comparators, the comparators having been enabled by a day of the week comparison. All of the foregoing will result in a pulse appearing on one of the sixteen programs out lines 150 from the program decode 95. This pulse will be sent to the external controller to signal that the function is to be put into action.

It should be noted that similar results, i.e. the same programming results could be achieved using microprocessor technology or other well-known solid state system technologies.

Although the detailed description has been keyed primarily to a panel like the control panel 10, further simplification can be made from the point of view of a non-experienced operator or programmer.

A panel 160 as shown in FIG. 4 has numerous switches and displays like those described in connection with panel 10. There are, however, certain noteworthy differences in the panel 160. Those elements common to both panels include a four-digit clock display 11 with attendant day of the week LED's 13, the clock including a.m. and p.m. indicators preceding four time digits 12. Those areas where there is a difference include items 18, 19 and 20 as appearing on the control panel 10, which here in control panel 160 are replaced by a set push button 161 meshing in concert with a summer LED 162 and a winter LED 163. The day code select switch 25 of panel 10 has been replaced by a rotating day select pointer 164 which functions with LED's 13 showing the seven days of the week. The program select switch 26 of the panel 10 has been replaced with a program select rotating pointer 165 which functions with a panel spelling out sixteen different bell programs which are spelled out for the benefit of the operator, instead of appearing merely as a numeral setting like the setting 30 of panel 10. The program display 31 of the panel 10 has been replaced by an array of LED's 166, these appearing in two columns of eight LED's in height with an LED corresponding to each of the programs available in the system.

In the device of the panel 160, for presetting the timer to make the automatic time change involving daylight saving time on Sunday morning at 2:00 a.m., the set push button 161 is pushed. If this button is pushed once, the summer LED 162 will light. When the set push button 161 is pushed a second time, the winter LED 163 will light. When the set push button 161 is pushed a third time, both LED's 162 and 163 will be dark. A simple solid state two bit (0-2) binary counter can be employed to perform this switching function.

The functioning of the day select rotating pointer 164 appears self-evident in that it is used for selecting the day or combination of days when one or more programs are to be entered into the RAM's 85, 86 and 87. Rotating the pointer 164 merely replaces rotation of the wheel 27 to show a desired numeral setting 28.

The operation of the rotating pointer 165 also appears self-evident in that it is merely rotated to the name designation of the program which is to be selected instead of the program being selected by manipulation in panel 10 of the wheel 29 to show a numeral reading 30. When the memory is to be read, an appropriate LED 166 will appear at a corresponding location showing what program has been entered rather than the program appearing by number at the program display 31 of the panel 10. The panel 160 in general substitutes labels, in effect, instead of requiring an appropriate program name to be correlated with a series of numbers.

I claim:

1. An electronically operated control clock system adapted to be operated from a single program control panel to play a program output at specific times of day on selected days throughout a chosen period, said system comprising a program unit selector on said panel and an accompanying electronic memory bank of program unit selections having a non-limited program unit capacity, a visual time display on said panel for display of selected days and hours of output and accompanying electronic clock implementation means, and an electric circuit interconnecting said program unit selector, said memory bank, said time display and said electronic clock implementation means, a day code selector for multiple day combinations throughout a weekly cycle and accompanying implementation means in said circuit, a day advance control with visual day information display means on said panel and accompanying electronic day advance decode means in said circuit, clock setting control means on said panel and accompanying electronic clock advance actuating means in said circuit, program enter and program clear implementation means in said circuit, switch means interconnected with said circuit for switching between a program setting cycle and program output cycle, said clock setting control means and accompanying clock advance actuators being operable in both said cycles, a visual output unit display, and reading control means on the panel with accompanying read implementation means in said circuit operable when said output cycle is in inactive condition for reading program information as visual output units and for reading corresponding time information.

2. An electronically operated control clock system as in claim 1 wherein there is an hour advance means on the panel including an actuator and corresponding visual read out means on the panel and accompanying hour advance electronic means in said circuit having settings respectively for a first time interval advance cycle and a second time interval advance cycle whereby to shift the entire program output at said specific times of day between a first setting and a second setting spaced by a time interval from said first setting.

3. An electronically operated control clock system as in claim 2 wherein said hour advance electronic means operates independently of other actuation means in said circuit.

4. An electronically operated control clock system as in claim 1 wherein the day code selector includes a visual index of single days and combinations of days with the corresponding day information visual display means on the panel being automatically responsive to the accompanying day decode means.

5. An electronically operated control clock system as in claim 1 wherein the program unit selector includes a visual index of program output identification with corresponding visual display means on the panel being automatically responsive to the accompanying implementation means in the circuit.

6. An electronically operated control clock system as in claim 1 wherein said clock setting control means comprises a plurality of push buttons respectively for slow set, fast set and seconds display.

7. An electronically operated control clock system as in claim 1 wherein the reading control means on the panel for actuating the reading of program information for a selected clock setting common to the seven days of the week is push button actuated.

8. An electronically operated control clock system as in claim 1 wherein the reading control means on the panel for actuating the reading of program information for a time span common to the seven days of the week covering a period from a selected clock setting to midnight is push button actuated.

9. An electronically operated control clock system as in claim 1 wherein the day code selector comprises a rotatable pointer and the days selected appear as corresponding words.

10. An electronically operated control clock system as in claim 1 wherein the program unit selector comprises a rotatable pointer and output unit selectors appear as corresponding words of identity for the programs.

11. An electronically operated control clock system as in claim 1 wherein the read implementation means includes individual lamps located one adjacent each word of identity for the program.

12. An electronically operated control clock system as in claim 1 wherein said reading control means includes a read memory switch, said visual output unit display for program unit selections being connected in circuit with said read memory switch, a program enable switch, a continuously operable clock advance means in said circuit responsive to said program enable switch, said continuously operable clock advance means having a continuous advance mode for an output cycle of 24 hours, said clock advance means being subject to temporary interruption whenever output time for program material stored in the electronic memory bank is coincident with clock display time, said continuously operable clock advance means being subject to renewal of the advance mode of the continuous cycle by actuation of said read memory switch.

13. An electronically operated control clock system as in claim 1 wherein there is a summer-winter type switch means on said panel connected in said circuit, activating means in said circuit responsive to said summer-winter type switch means for setting said activating means for operation at a specified time on a specific day, said activating means including means for implementing an automatic shift in the performance of said system to a time one hour removed from an initial time for which the system has been set.

14. An electronically operated control clock system as in claims 10 or 11 wherein program units and corresponding times are displayed on a specific day schedule in response to push button actuation.

15. An electronically operated control clock system as in claim 20 wherein a single push button is productive of said push button actuation.

16. An electronically operated control clock system as in claim 1 wherein said electronic memory bank of program unit selectors comprises a plurality of random access memory units, said memory units being of variable capacity and number.

17. An electronically operated control clock system as in claim 1 wherein said program enter implementation means has arbitrary hour, minute and second settings throughout the day and substantially without limit respecting the number of program unit selections.

18. An electronically operated control clock system as in claim 1 wherein said day code selector includes a single setting for a repeat performance on an every day schedule.

* * * * *